US006418965B2

(12) United States Patent
Bryselbout

(10) Patent No.: US 6,418,965 B2
(45) Date of Patent: Jul. 16, 2002

(54) DEVICE FOR STORING AND MIXING TWO GASES

(75) Inventor: Francis Bryselbout, Le Mesnil St Denis (FR)

(73) Assignee: L'Air Liquide Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/870,657

(22) Filed: Jun. 1, 2001

(30) Foreign Application Priority Data

Jun. 20, 2000 (FR) ..... 00 07838

(51) Int. Cl.[7] ..... F17D 1/02

(52) U.S. Cl. ..... 137/606; 137/264; 137/896; 137/897

(58) Field of Search ..... 137/264, 255, 137/602, 896, 897, 605, 606

(56) References Cited

U.S. PATENT DOCUMENTS 2,200,675 A * 5/1940 Northcutt ..... 137/264
3,635,375 A 1/1972 Gaetke
3,645,291 A 2/1972 Finney
4,923,394 A 5/1990 Fumino
5,649,433 A 7/1997 Suzuki et al.

OTHER PUBLICATIONS

Search Report issued in French Application No. 00 07838.

* cited by examiner

*Primary Examiner*—Kevin Lee
(74) *Attorney, Agent, or Firm*—Burns, Doane, Swecker & Mathis, L.L.P.

(57) ABSTRACT

The invention relates to a device for storing and mixing two gases or mixtures of gases under pressure. The device includes: an outer chamber containing the first of the gases and being equipped with an opening; an inner chamber arranged inside the outer chamber containing the second gas, and being equipped with an opening; a two-way valve which includes a body fixed hermetically in the opening of the outer chamber, a first passage having one end connected to the inner chamber and being equipped with a first controllable shut-off device, and a second passage having a first end connected to the outer chamber and being equipped with a second controllable shut-off device; first and second flow rate and pressure adjusting devices, each being connected to one of the passages of the valve; and first and second pipes for connecting the outlet of each adjusting device to a single outlet.

9 Claims, 1 Drawing Sheet

DEVICE FOR STORING AND MIXING TWO GASES

BACKGROUND OF THE INVENTION

1. Field of the Invention

Figure 1:
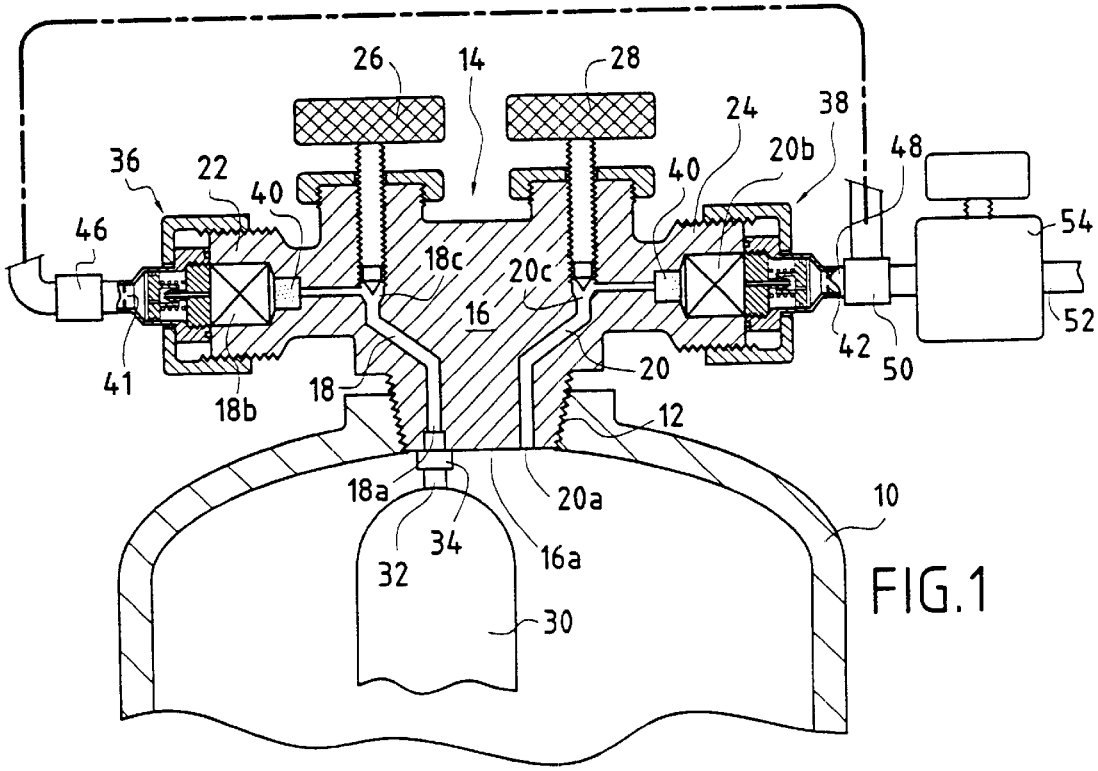

The subject of the present invention is a device for storing and mixing two gases or two mixtures of gases under pressure.

More specifically, the invention relates to a device which allows two gases or two mixtures of gases to be stored for the required time under pressure and mixed in given proportions at the time said mixture is to be used.

2. Description of the Related Art

Mixtures with a very low content, for example a few parts per billion (ppb) or fractions of parts per million (ppm) of active gases such as $SO_2$ or $NO_x$ are relatively tricky to prepare and to store and often pose problems associated with keeping the mixture in their storage cylinder and of using them in situ.

This is why it has been proposed for this mixture to be prepared using a diluent. In order to implement this technique, it is necessary to have a cylinder of the gas that is to be diluted and its pressure reducer, a cylinder of diluent gas and its pressure reducer, and a diluting mixer. If the time needed to purge the circuits connecting these various components and the cost of these various components are taken into consideration, producing a mixture with a very low content becomes a prohibitive proposition.

SUMMARY OF THE INVENTION

One object of the present invention is to provide a device which makes it possible to store and to mix two gases or two mixtures of gases which allows the final mixture to be prepared in situ with an accuracy regarding the proportions of the various components which is at least as good as in the prior art and which allows very low proportions of some of the gases, these being of the order of a fraction of ppm or of a few ppb.

In order to achieve this object according to the invention, the device for storing and mixing two gases or mixtures of gases under pressure comprises:

- an outer chamber containing the first of said gases and equipped with an opening;
- an inner chamber arranged inside said outer chamber containing the second gas and equipped with an opening;
- a two-way valve comprising a body fixed hermetically in the opening of the outer chamber, a first passage having an inner end connected to the opening of the inner chamber and an outer end and equipped with first controllable shut-off means, and a second passage having a first inner end opening into the said outer chamber and a second outer end and being equipped with second controllable shut-off means,
- first and second means of adjusting flow rate and pressure, each having an inlet connected to the outer outlet of one of the passages of said two-way valve and an outlet; and
- first and second pipes for connecting the outlet of each adjusting means to a single outlet of said storing and mixing device.

It will be understood that the mixture of active gases to be diluted is already diluted in acceptable proportions, for example of the order of a few ppm, in the inner chamber while the outer chamber contains the diluent gas. Given the degree of dilution of the active gases in the inner chamber, the latter can be produced initially with ease and precision and its storage does not pose any particular problems. When using the final mixture, it is possible to mix this in situ by opening the two valves, which makes it possible to obtain, at the outlet of the entire device, the mixture of the active gases in the desired proportions with the desired flow rate and at the desired pressure by virtue of the presence of the reducers and of the calibrated orifices.

As a preference, the mixtures of gas or the gases contained in the two chambers are at the same pressure and the ratio of the volumes of the two chambers is equal to the ratio of the quantities of gas or mixtures of gas to be withdrawn from the two chambers in order to obtain the final mixture.

It should also be emphasized that once the inner chamber and the two-way valve have been fitted inside the outer chamber, the two chambers can easily be conditioned and filled via the two-way valve.

BRIEF DESCRIPTION OF THE FIGURE OF THE DRAWING

Figure 2:
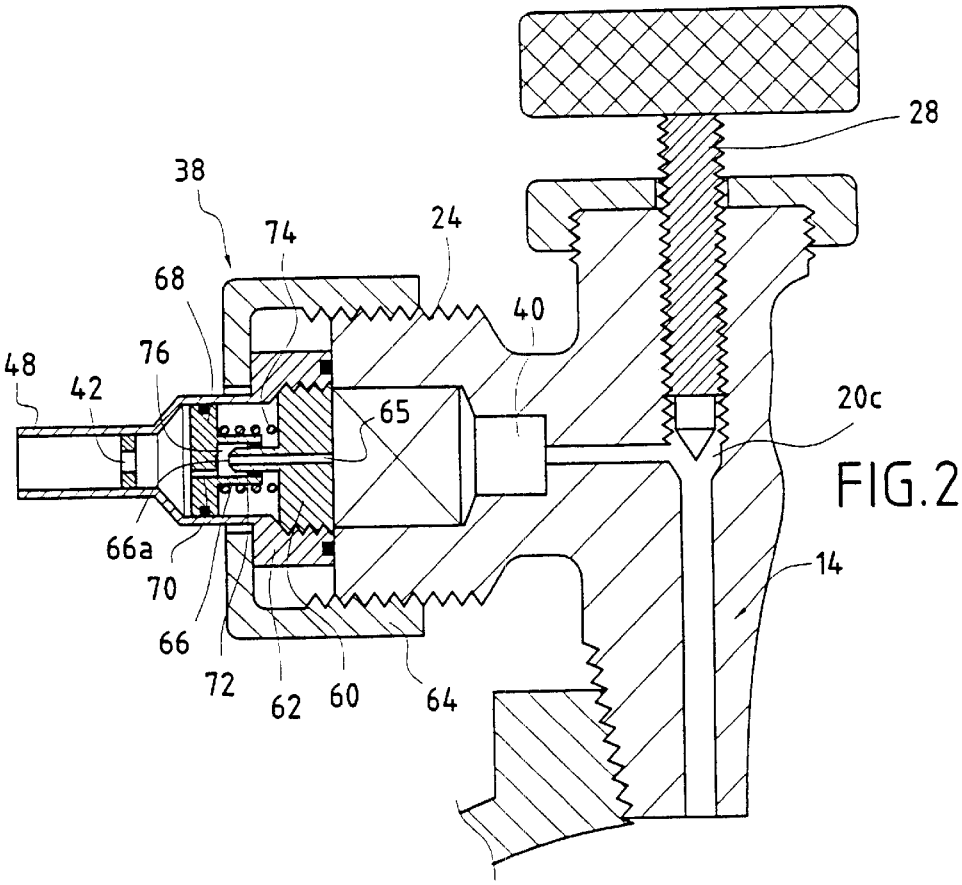

Further features and advantages of the invention will become clearer upon reading the description of a preferred embodiment of the invention which is given by way of non-limiting example. The description makes reference to the appended drawings in which:

FIG. 1 is a view in axial section of the upper part of the storage and mixing device; and FIG. 2 is a part view of the device showing one embodiment of the reducer associated with each channel of the two-way valve.

DETAILED DESCRIPTION OF THE PREFERRED EMBODIMENTS

The entire mixing and storage device will be described with reference first of all to FIG. 1.

This device consists first of all of a pressure-resistant outer cylinder 10 intended to contain the diluent gas or gas mixture. The cylinder 10 has an upper opening 12 in which a two-way valve 14 is engaged, the body 16 of which valve is fixed hermetically in the opening 12. The two-way valve 14 essentially comprises two passages 18 and 20, a first end 18*a*, 20*a* of which opens into the lower face 16*a* of the body of the two-way valve and a second end 18*b*, 20*b* of which opens into bosses 22 and 24 of the two-way valve body. Part of each passage, referenced 18*c* and 20*c* respectively, constitutes a seat for a shut-off element formed, respectively, by check screws 26 and 28. The check screws 26 and 28 together with the seats 18*c* and 20*c* constitute on/off shut-off members.

Mounted inside the outer chamber 10 is a pressure-resistant inner cylinder 30, the opening 32 of which is connected to the end 18*a* of the first passage of the two-way valve by a duct 34. The duct 34 serves both to allow a connection between the inner chamber 30 and the passage 18 and to mechanically secure the chamber 30 to the two-way valve.

Each boss 22 and 24 of the two-way valve, into which boss the ducts 18 and 20 open, is equipped with a respective reducer referenced 36 and 38. A particular example of such reducers will be described later on with reference to FIG. 2. As a preference, a filter 40 is inserted at the outlet of the passages 18 and 20 upstream of the reducers 36 and 38. The outlet of the reducers is equipped with a calibrated orifice 41 and 42 making it possible to set the flow rate of gas flowing through the pipes 46 and 48 connected at the outlet of the reducers.

The pipe 46 continues as far as a T-coupling 50 which is itself connected to the overall outlet pipe of the device 52. As a preference, this overall outlet pipe is equipped with a control valve 54.

The use of the device described with reference to FIG. 1 is clearly apparent. In an initial phase, the inner chamber 30 fixed to the two-way valve 16 is fitted inside the outer chamber 10 and the body of the two-way valve is fixed hermetically in the opening 12 of the outer chamber. With the aid of the passages 18 and 20, the inner chamber 30 and the outer chamber 10 undergo conditioning and initial filling. After this conditioning and filling, the check screws 26 and 28 shut off these two chambers. In this state, the gases or mixtures of gases contained in the chambers 10 and 30 can be stored for the desired length of time. It goes without saying that the inner chamber 30 needs preferably to have transverse dimensions smaller than the cross section of the opening 12 of the outer chamber 10 so that it can be fitted inside the chamber 10.

When there is a desire to use the gas mixture, the reducers 36 and 38 are set to supply an outlet pressure which is preferably identical for both gases. Furthermore, the calibrated orifices 41 and 42 have been designed to supply the desired respective flow rates for each of the two gases. By opening the two check screws 26 and 28 which act as on/off shut-off members, flow rates of each of these gases under the desired pressures are obtained in the pipe 50 and in the pipe 46. The gases thus mix in the outlet pipe 52 in the proportions defined by the respective flow rates of each of the gases and by the concentration of the gases in the chambers 10 and 30.

One embodiment of the reducers will now be described with reference to FIG. 2. The reducer 38 comprises a body 60, 62 which is fixed to the boss 24 by a threaded ring 64. The part 60 of the body is pierced with an axial passage 65 which is continued via a pipe 66 of end 66*a*. Inside the space defined by the body 62, a disk 68 is mounted to move in translation along the axis of the reducer. This disk 68 has an orifice 70 which is eccentric with respect to the axis of the reducer and therefore with respect to the pipe 66. The disk 60 is equipped on its face facing towards the pipe 66, with a sleeve 72 which collaborates with the pipe 66 and is connected to the body of the reducer by a spring 74. Furthermore, the portion 76 of the face of the disk 70 facing towards the pipe 66 constitutes a seat for the end 66*a* of the pipe 66.

The spring 74 makes it possible to define the pressure at which gas leaves the reducer because, as will be realized, depending on the pressure of the gas in the space within the reducer, the disk 66 is moved away from the end of the pipe 66 to a greater or lesser extent and, more specifically, when the pressure is below the set point value, the pipe 66 is shut off by the seat 76 whereas when this pressure becomes higher, the disk 68 is moved away and gas is let out again.

It goes without saying that other types of reducer could be used.

In one particular embodiment, the outer chamber 10 has a volume of 20 l and the inner chamber 30 has a volume of the order of 170 $cm^3$. The inner cylinder 30 may have a height of the order of 750 mm, an external cross section with a diameter of the order of 20 mm and an internal cross section with a diameter of the order of 17 mm. The ratio between the volumes of the outer chamber and of the inner chamber is therefore of the order of 1%. If set flow rates of 1 000 $cm^3$/min for the gas contained in the outer chamber and 10 $cm^3$/min of gas to be diluted contained in the inner chamber and an outlet pressure upstream of the calibrated orifices of the order of 2 bar absolute are desired, then the calibrated orifice 41 associated with the inner chamber will have a diameter of 25 $\mu$m and the calibrated orifice 42 associated with the gas of the outer chamber will have a diameter of 250 $\mu$m. If the two chambers are pressurized at a pressure of the order of 150 bar, the apparatus will be able to be used constantly for about 66 h. Such a device may make it possible to produce the following concentrations: for 1 ppm concentration of active gas in the outer chamber, the final concentration will be of the order of 10 ppb and for 10 ppm of active gas in the inner chamber, the final concentration obtained will be of the order of 100 ppb.

What is claimed is:

1. Device for storing and mixing two gases or mixtures of gases under pressure, comprising:

an outer chamber containing the first of said gases and equipped with an opening;

an inner chamber arranged inside said outer chamber containing the second gas and equipped with an opening;

a two-way valve comprising a body fixed hermetically in the opening of the outer chamber, a first passage having an inner end connected to the opening of the inner chamber and an outer end, and a first controllable shut-off means associated with said first passage, and a second passage having a first inner end opening into said outer chamber and a second outer end, and a second controllable shut-off means associated with said second passage, first and second means of adjusting flow rate and pressure, each having an inlet connected to the outer outlet of one of the passages of said two-way valve and an outlet; and first and second pipes for connecting the outlet of each adjusting means to a single outlet of said storing and mixing device.

2. Device according to claim 1, characterized in that said inner chamber is shaped in such a way that said inner chamber can be introduced into said outer chamber via said opening in said outer chamber.

3. Device according to claim 1, characterized in that the opening of said inner chamber is connected to the inner outlet of the first passage of said two-way valve by a sleeve tube which also forms means of supporting and fixing said inner chamber to said two-way valve.

4. Device according to claim 1, characterized in that each adjusting means comprises a pressure reducer and a calibrated orifice arranged at the outlet of the reducer.

5. Device according to claim 4, characterized in that the two gases are at roughly the same pressure in their respective chambers and in that the two reducers effect the same reduction ratio.

6. Device according to claim 5, characterized in that the respective volumes of the inner and outer chambers are roughly in the ratio of the respective flow rates of the first and second gases supplied by said calibrated orifices.

7. Device according to claim 2, characterized in that the opening of said inner chamber is connected to the inner outlet of the first passage of said two-way valve by a sleeve tube which also forms means of supporting and fixing said inner chamber to said two-way valve.

8. Device according to claim 2, characterized in that each adjusting means comprises a pressure reducer and a calibrated orifice arranged at the outlet of the reducer.

9. Device according to claim 3, characterized in that each adjusting means comprises a pressure reducer and a calibrated orifice arranged at the outlet of the reducer.

* * * * *